US007692585B2

(12) United States Patent
Mohamadi

(10) Patent No.: US 7,692,585 B2
(45) Date of Patent: Apr. 6, 2010

(54) RFID READER AND ACTIVE TAG

(76) Inventor: Farrokh Mohamadi, 8 Halley, Irvine, CA (US) 92612-3797

( * ) Notice: Subject to any disclaimer, the term of this patent is extended or adjusted under 35 U.S.C. 154(b) by 0 days.

(21) Appl. No.: 12/245,628

(22) Filed: Oct. 3, 2008

(65) Prior Publication Data

US 2009/0027266 A1 Jan. 29, 2009

Related U.S. Application Data

(63) Continuation of application No. 11/153,019, filed on Jun. 14, 2005, now Pat. No. 7,432,855, which is a continuation-in-part of application No. 10/860,526, filed on Jun. 3, 2004, now Pat. No. 6,982,670.

(51) Int. Cl.
*H01Q 3/00* (2006.01)
*G08B 13/14* (2006.01)

(52) U.S. Cl. ..... 342/368; 340/572.1

(58) Field of Classification Search ..... 342/368; 340/572.1

See application file for complete search history.

(56) References Cited

U.S. PATENT DOCUMENTS 7,054,595 B2 * 5/2006 Bann ..... 455/41.2
7,304,575 B2 * 12/2007 Posamentier ..... 340/572.1

* cited by examiner

*Primary Examiner*—Thomas H Tarcza
*Assistant Examiner*—Harry Liu
(74) *Attorney, Agent, or Firm*—Haynes & Boone, LLP.

(57) ABSTRACT

In one embodiment, an RFID reader and active tag (RAT) includes: a first antenna; a second antenna orthogonally aligned with the first antenna; an RFID interface operable to generate RF transmissions to the interrogate RFID tags; a fixed phase variable gain beam forming interface coupled to the first and second antennas and to the RFID interface, the variable gain beam forming interface being operable to independently adjust a set of gains for the RF transmissions from the RFID interface to the antennas so as to steer an interrogating RF transmission throughout the space to obtain RFID data from the RFID tags within the space; a third antenna; and a wireless interface configured to communicate through the third antenna with an access point, the wireless interface being operable to transmit the RFID data to the access point.

15 Claims, 6 Drawing Sheets

RFID READER AND ACTIVE TAG

RELATED APPLICATIONS

This application is a continuation of U.S. application Ser. No. 11/153,019, filed Jun. 14, 2005 now U.S. Pat. No. 7,432,855, which in turn is a continuation-in-part of U.S. application Ser. No. 10/860,526, filed Jun. 3, 2004, now U.S. Pat. No. 6,982,670, the contents of both of which are hereby incorporated by reference in their entireties.

TECHNICAL FIELD

The present invention relates generally to RFID applications, and more particularly to an RFID reader configured to wirelessly communicate with an access point.

BACKGROUND

Radio Frequency Identification (RFID) systems represent the next step in automatic identification techniques started by the familiar bar code schemes.

Unlike bar codes that can smear or be obscured by dirt, RFID tags are environmentally resilient. Whereas bar code systems require relatively close proximity and line-of-sight (LOS) contact between a scanner and the bar code being identified, RFID techniques do not require LOS contact and may be read at relatively large distances. This is a critical distinction because bar code systems often need manual intervention to ensure proximity and LOS contact between a bar code label and the bar code scanner. In sharp contrast, RFID systems eliminate the need for manual alignment between an RFID tag and an RFID reader or interrogator so as to enable readability of concealed RFID tags, thereby keeping labor costs at a minimum. Moreover, RFID tags may be written to in one-time programmable (OTP) or write-many fashions whereas once a bar code label has been printed further modifications are impossible. These advantages of RFID systems have resulted in the rapid growth of this technology despite the higher costs of RFID tags as compared to a printed bar code label.

The non-LOS nature of RFID systems is both a strength and a weakness, however, because one cannot be sure which RFID tags are being interrogated by a given reader. In addition, RFID tag antennas are inherently directional and thus the spatial orientation of the interrogating RF beam can be crucial in determining whether an interrogated RFID tag can receive enough energy to properly respond. This directionality is exacerbated in mobile applications such as interrogation of items on an assembly line. Moreover, it is customary in warehousing and shipping for goods to be palletized. Each item on a pallet may have its RFID tag antenna oriented differently, thus requiring different RF beam interrogation directions for optimal response. As a result, conventional RFID readers are often inefficient while being relatively expensive.

Accordingly, there is a need in the art for improved low-cost RFID readers.

SUMMARY

In accordance with one aspect of the invention, an RFID reader and active tag includes: a first antenna; a second antenna orthogonally aligned with the first antenna; an RFID interface operable to generate RF transmissions to the interrogate RFID tags; a fixed phase variable gain beam forming interface coupled to the first and second antennas and to the RFID interface, the variable gain beam forming interface being operable to independently adjust a set of gains for the RF transmissions from the RFID interface to the antennas so as to steer an interrogating RF transmission throughout the space to obtain RFID data from the RFID tags within the space; a third antenna; and a wireless interface configured to communicate through the third antenna with an access point, the wireless interface being operable to transmit the RFID data to the access point.

In accordance with another aspect of the invention, a method for interrogating a plurality of RFID tags occupying a space using a first antenna and a second antenna orthogonally aligned with the first antenna is provided that comprises: producing an RF interrogating signal for interrogating the RFID tags; amplifying the RF interrogating signal through a first variable gain amplifier to drive the first antenna; amplifying the RF interrogating signal through a second variable gain amplifier to drive the second antenna; and changing a gain for the first variable gain amplifier and a gain for the second variable gain amplifier such that a resulting RF transmission from the first and second antennas steers through the space to interrogate all the RFID tags to obtain RFID data.

In accordance with another aspect of the invention, an RFID reader and active tag (RAT) is provided that includes: a first beam forming means for interrogating a plurality of RFID tags using at least a first set of two antennas coupled to a first fixed phase feed network, the beam forming means being configured to adjust gains in the first fixed phase feed network to scan with respect to the plurality of RFID tags; and a second means for uploading RFID data from the interrogated plurality of RFID tags to an external access point.

The invention will be more fully understood upon consideration of the following detailed description, taken together with the accompanying drawings.

DETAILED DESCRIPTION

An RFID reader is provided that incorporates the beam forming techniques disclosed in U.S. Ser. No. 10/860,526 to enable the interrogation of multiple RFID tags such as those found on palletized or containerized goods. Because the RFID reader will use the efficient yet inexpensive-to-implement beam forming techniques of U.S. Ser. No. 10/860,526, the directionality problems encountered with reading RFID tags of varying orientations using a single RFID beam are alleviated. These same beam forming techniques may be applied to a wireless interface the RFID reader includes to wirelessly communicate with an external access point using a suitable wireless protocol such as IEEE 802.11. In that sense, the RFID reader also acts as an active RFID tag with respect to the access point. Because the RFID reader also acts as an active RFID tag in that it may be interrogated by a remote AP to provide RFID data it has obtained, it will be denoted as an RFID reader active tag (RAT) in the following discussions.

Figure 1:
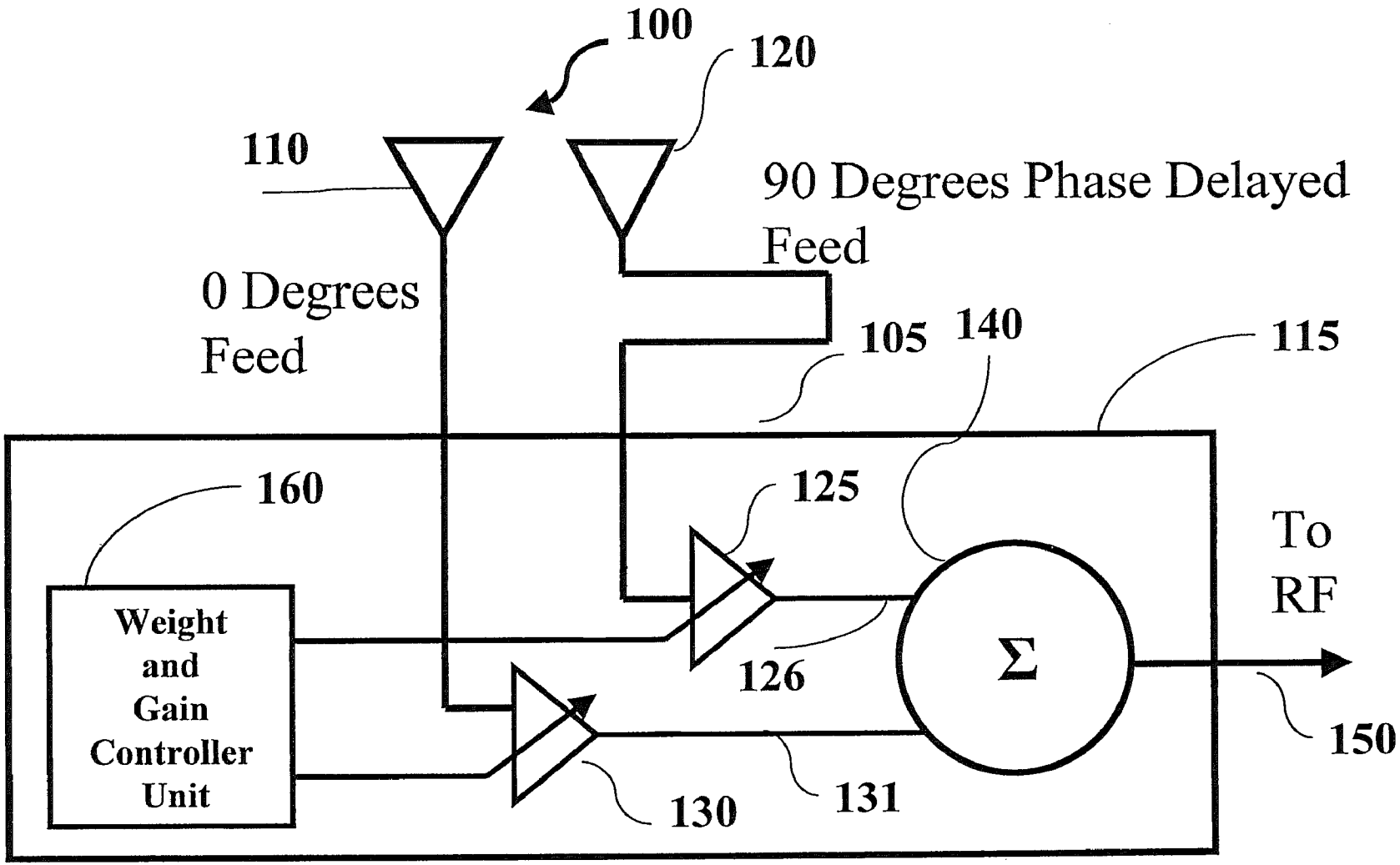
FIG. 1 is a block diagram of an antenna array having a fixed-phase feed network configured to provide beam steering of received signals through gain adjustments according to one embodiment of the invention.
Figure 2:
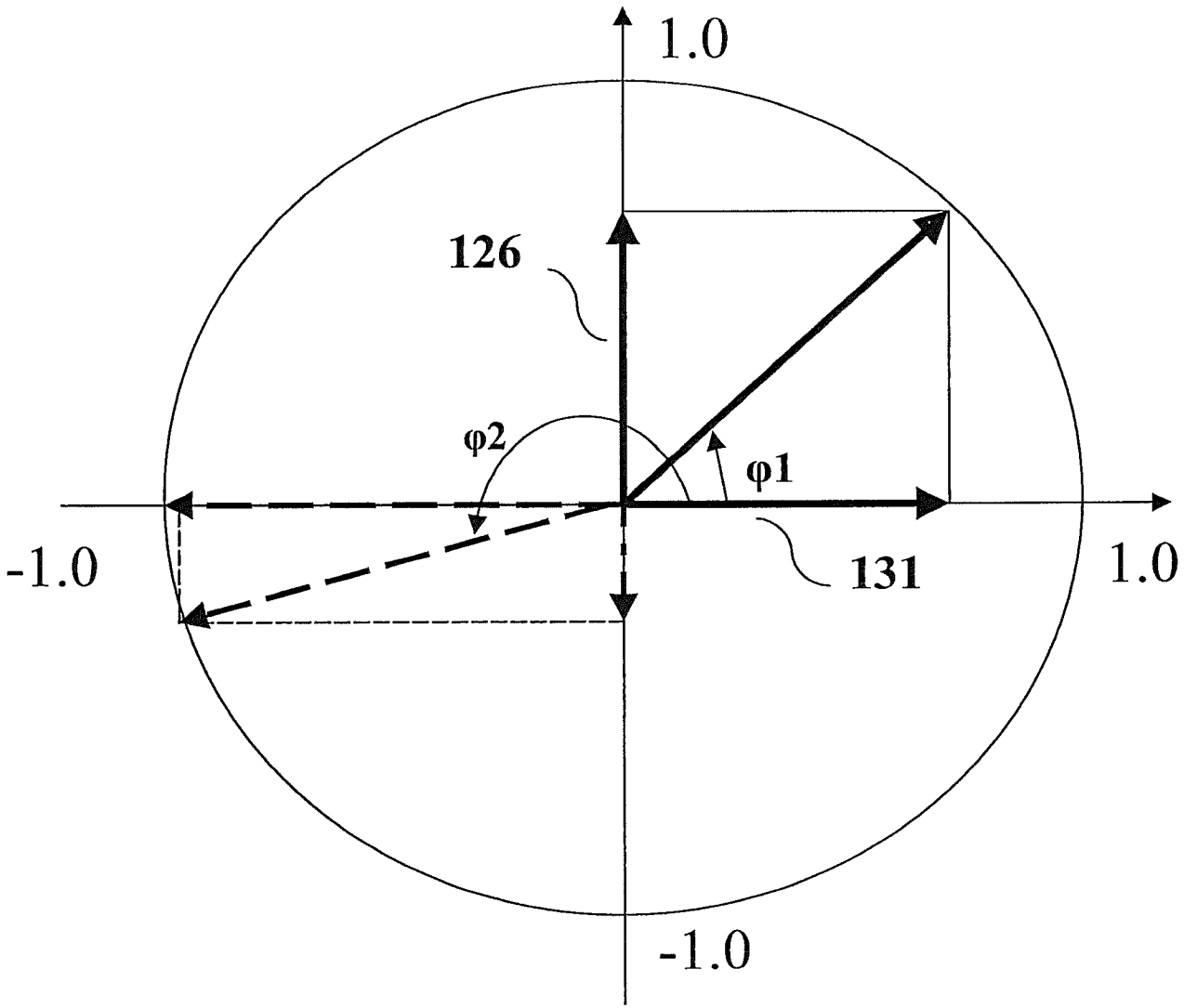
FIG. 2 illustrates the beam-steering angles achieved by the antenna array of FIG. 1 for a variety of gain settings.

Advantageously, the beam forming techniques disclosed in U.S. Ser. No. 10/860,526 may be conveniently integrated with conventional wireless interfaces in the RAT such as an 802.11 interface as well as conventional RFID interfaces. This integration is convenient because an 802.11 interface transmits and receives on a single RF channel in a half-duplex mode of operation. The same is true for an RFID interface (but at a different operating frequency). Because the beam forming technique disclosed in U.S. Ser. No. 10/860,526 is performed in the RF domain, this beam forming is non-intrusive and thus transparent to these signal RF channel interfaces. The single RF channel beam forming technique may be further described with respect to FIG. 1. A beam forming antenna array 100 including antennas 110 and 120 receives and transmits with respect to a fixed-phase feed network 105. The lengths of each channel within the fixed-phase feed network may be equal if antennas 110 and 120 are configured to transmit and receive substantially orthogonal to each other. If they are aligned, however, as shown in FIG. 1 such that their directivities are parallel, the fixed phase network should be configured so as to introduce a substantially ninety degree phase shift between antennas 110 and 120. For example, a received signal from antenna 110 will couple through network 105 to be received at a beamforming circuit 115 leading in phase ninety degrees with respect to a received signal from antenna 120. Examples of such a fixed-phase feed network may be seen in PCMCIA cards, wherein one antenna is maintained 90 degrees out of phase with another antenna to provide polarization diversity. However, rather than implement a complicated MEMs-type steering of antenna elements 110 and 120 as would be conventional in the prior art, variable gain provided by variable-gain amplifiers 125 and 130 electronically provides beam steering capability. Amplifiers 125 and 130 provide gain-adjusted output signals 126 and 131, respectively, to a summing circuit 140. Summing circuit 140 provides the vector sum of the gain-adjusted output signals from amplifiers 125 and 130 as output signal 150. Variable-gain amplifiers 125 and 130 may take any suitable form. For example, amplifiers 125 and 130 may be implemented as Gilbert cells. A conventional Gilbert cell amplifier is constructed with six bipolar or MOS transistors (not illustrated) arranged as a cross-coupled differential amplifier. Regardless of the particular implementation for variable-gain amplifiers 125 and 130, a controller 160 varies the relative gain relationship between the variable gain amplifiers to provide a desired phase relationship in the output signal 150. This phase relationship directly applies to the beam steering angle achieved. For example, should controller 160 command variable-gain amplifiers 125 and 130 to provide gains such that their outputs 126 and 131 have the same amplitudes, the resulting phase relationship between signals 126 and 131 is as shown in FIG. 2. Such a relationship corresponds to a beam-steering angle $\phi 1$ of 45 degrees. However, by adjusting the relative gains amplifiers 125 and 130, alternative beam-steering angles may be achieved. For example, by configuring amplifier 130 to invert its output and reducing the reducing the relative gain provided by amplifier 125, a beam-steering angle $\phi 2$ of approximately −195 degrees may be achieved. In this fashion, a full 360 degrees of beam steering may be achieved through appropriate gain and inversion adjustments. It will be appreciated that orthogonality (either in phase or antenna beam direction) is optimal for beam steering. However, other relationships may be used, at the cost of reduced beam steering capability. For example, feed network 105 could be constructed such that antenna 110 is fed 45 degrees (rather than 90 degrees) out of phase with respect to the antenna 120.

Figure 3:
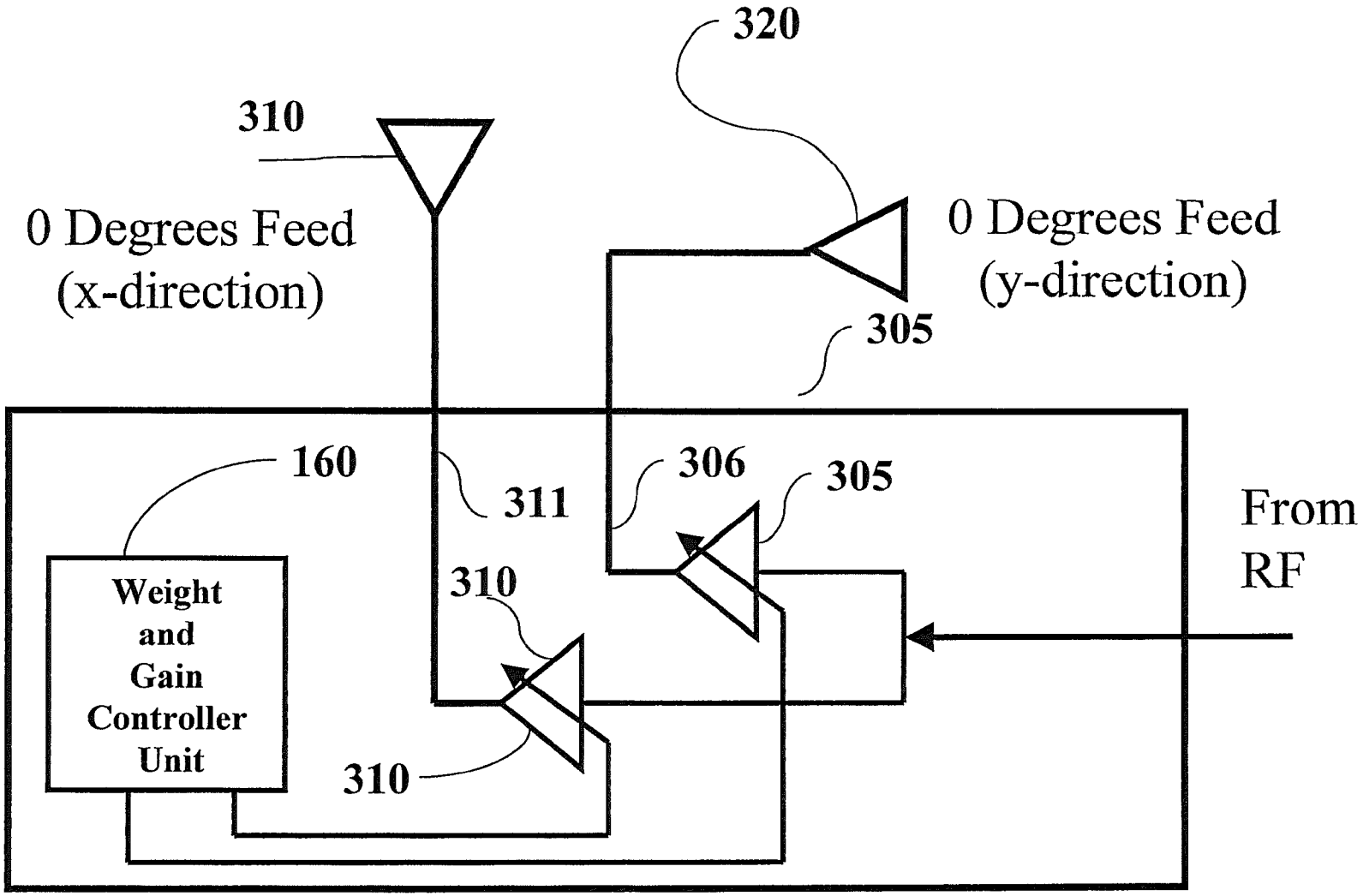
FIG. 3 is a block diagram of an antenna array having a fixed-phase feed network configured to provide beam steering of transmitted signals through gain adjustments according to one embodiment of the invention.

The fixed-phase feed network with variable gain steering approach discussed with respect to signal reception in FIG. 1 may also be used for beam steering for transmission as well. For example, a full 360 degrees of beam steering may be achieved for transmitted signals. As seen in FIG. 3, antennas 110 are now oriented in space such that their RF antenna beam directivities are orthogonal to each other. In such an embodiment, a fixed phase feed network 305 is configured such that antennas 110 and 120 are fed in phase with each other. A pair of variable gain amplifiers 305 and 310 receive an identical RF feed from either an IF or baseband processing stage (not illustrated) and adjust the gains of output signals 306 and 311, respectively, in response to gain commands from controller 160. Fixed-phase feed network 105 transmits signals 311 and 306 such that they arrive in phase at antennas 110 and 120, respectively. Depending upon the relative gains and whether amplifiers 305 and 310 are inverting, a full 360 degrees of beam steering may be achieved as discussed with respect to FIG. 1.

Figure 4:
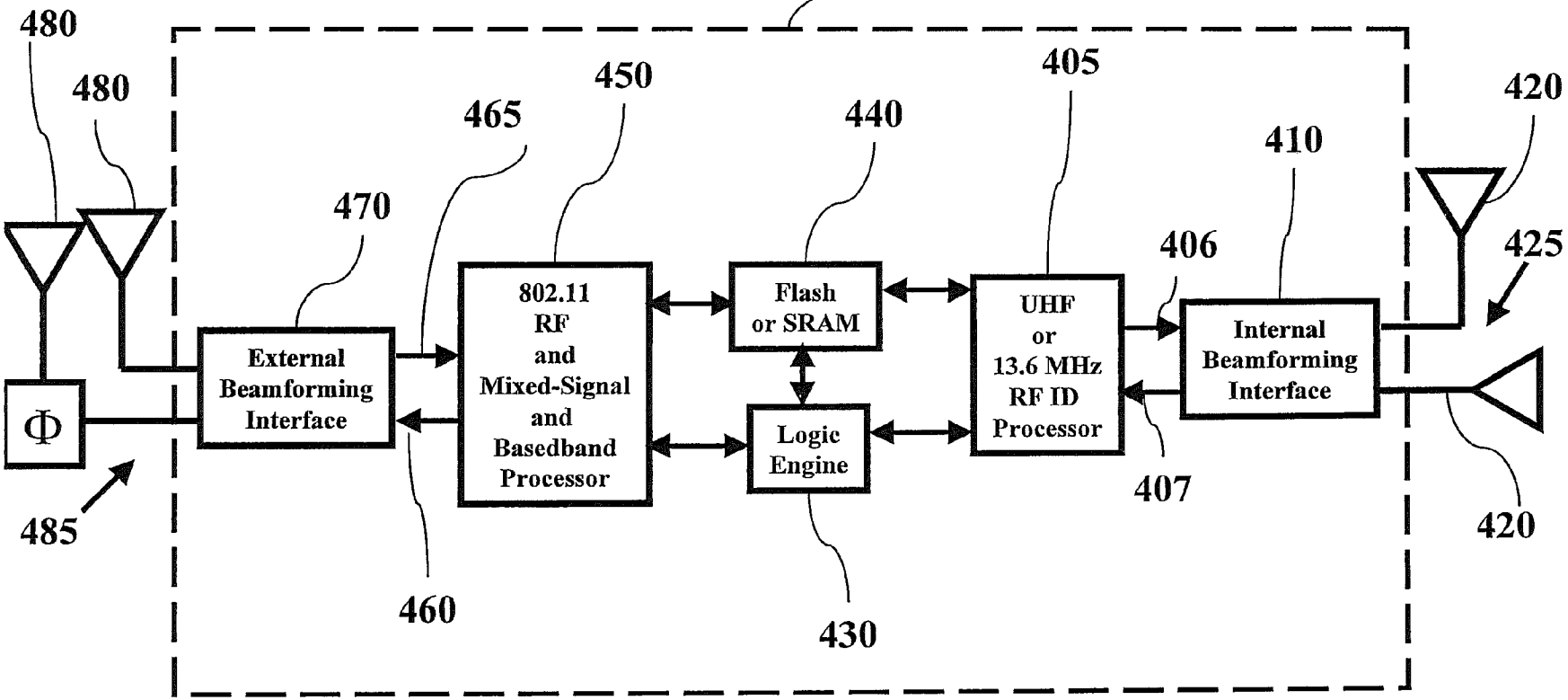
FIG. 4 is a block diagram of an RFID reader and active tag (RAT) in accordance with an embodiment of the invention.

It will be appreciated that the gain-based beam-steering described with respect to FIGS. 1 and 3 may be applied to an array having an arbitrary number of antennas. Regardless of the number of antennas, the beam forming is transparent to the IF or baseband circuitry because it is performed in the RF domin, rather than in the IF or baseband domains. This beam forming may be applied in an exemplary embodiment of a RAT 400 as seen in FIG. 4. RAT 400 includes an RFID interface 405 configured to interrogate RFID tags as known in the art. Thus, RFID interface 405 generates an appropriate RF signal 406 for transmission through an antenna to the RFID tags that are to be interrogated. RFID interface 405 is also configured as known in the art to receive the resulting transmissions from the interrogated RFID tags as an RF signal 407, which interface 405 demodulates to determine the encoded information in the interrogated RFID tags. In a conventional RFID reader, RF signal 406 would be transmitted and RF signal 407 received without any beam forming being performed. However, a fixed phase, variable gain beam forming interface circuit 410 receives RF signal 406 and drives a plurality of RFID antennas 420 as discussed above. Thus, RFID antennas 420 may be arranged to radiate in parallel such that a fixed phase network 425 coupling interface 410 and antennas 420 would introduce a phase difference. Alternatively, RFID antennas 420 may be oriented orthogonally in space as illustrated in FIG. 4 such that fixed phase network 425 would not introduce a phase difference. Variable gain amplifiers (not illustrated) within beam forming interface 410 control the gain in each channel as discussed with respect to FIGS. 1 and 3. It will be appreciated that phase differences or spatial arrangements of less than 90 degrees may utilized as discussed above. A logic engine 430 implemented in, for example, a field programmable gate array (FPGA) controls RFID interface 405 and beam forming interface 410. Thus logic engine 430 may perform the functions of controller 160 discussed with respect to FIGS. 1 and 3. RFID interface may operate at any appropriate RFID frequency such as 13.56 MHz, 433 MHz, 868 MHz, or 915 MHz (the latter three frequencies being typically referred to as UHF bands).

RFID interface 405 may store the resulting RFID data from the interrogated tags in a memory such as flash memory 440. In turn, an AP (not illustrated) interrogates RAT 400 to provide this RFID data. Thus, a wireless interface such as an 802.11 interface 450 retrieves the RFID data from memory 440 and modulates an RF signal 460 accordingly. A fixed phase, variable gain beam forming interface circuit 470 receives RF signal 460 and drives a plurality of 802.11 antennas 480 using a fixed phase feed network 485. Logic engine 430 controls beam forming interface circuit 470 to provide the desired beam forming angle to transmit to the AP. In addition, the beam forming would also apply to a received RF signal 465 from the AP. As discussed with respect to antennas 420, antennas 480 may be arranged to transmit and receive orthogonally to each other or in parallel. As illustrated, antennas 480 are arranged in parallel and thus fixed phase feed network 485 introduces a phase difference Φ such as ninety degrees.

Figure 5:
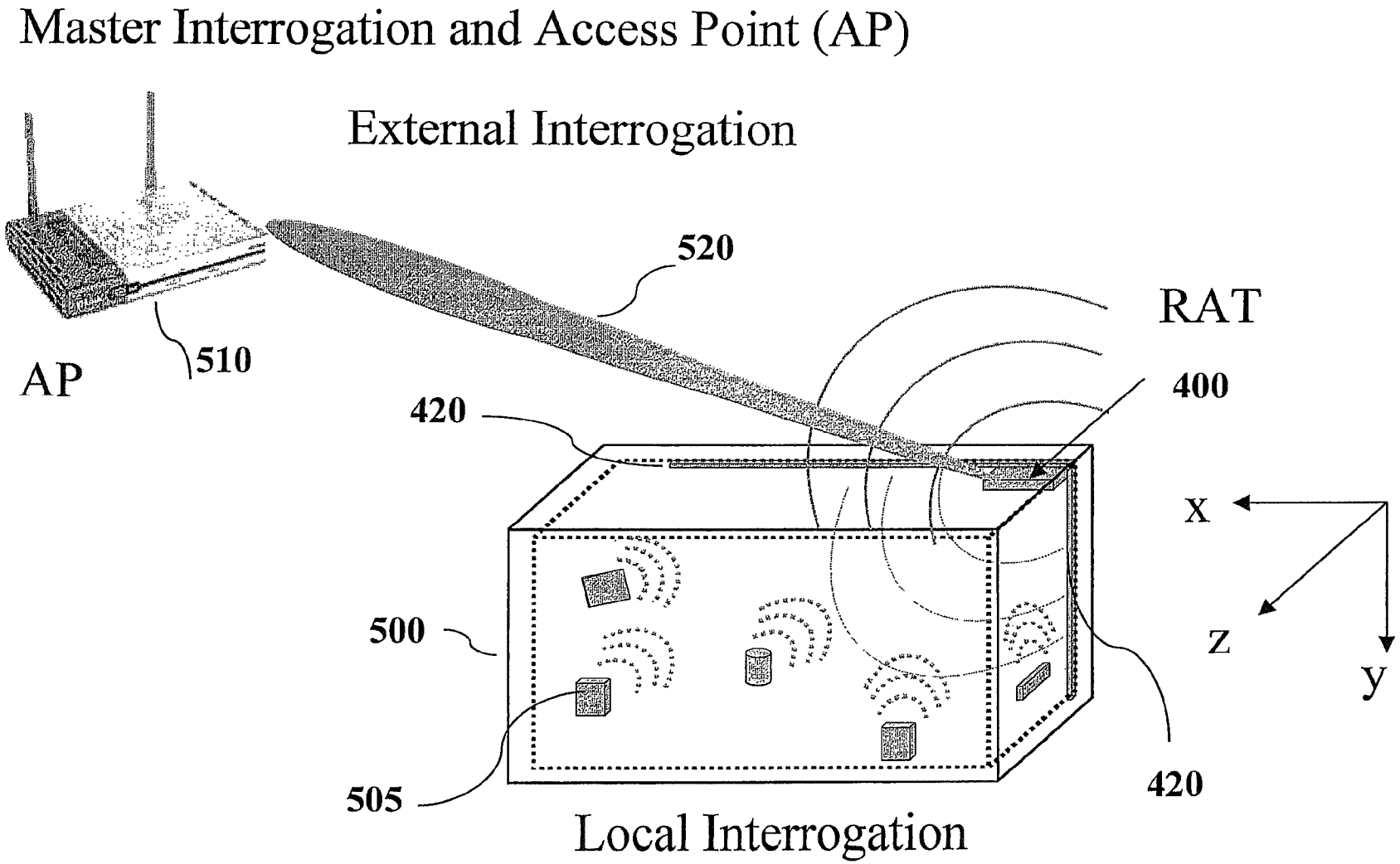
FIG. 5 illustrates the RAT of FIG. 4 in an exemplary industrial environment in accordance with an embodiment of the invention.

An exemplary usage of RAT 400 is illustrated in FIG. 5. RAT 400 is attached to a container or pallet 500 that includes a plurality of items each having their own RFID tag 505. As shown by the emanations from tags 505, each tag has its preferred direction of interrogation that may be different from other tags in container/pallet 500. RAT 400 scans through a plurality of interrogation directions to interrogate RFID tags 505. This type of scanning may be thorough, such as a full 360 degree scan as discussed with respect to FIG. 2. Alternatively, a subset of directions may be scanned. For example, in the X-Y plane, a beam at 0 degrees and 90 degrees may be used to interrogate the tags. Similarly, in the X-Z plane a beam at 0 and 90 degrees may also be used. Having interrogated the tags, the resulting RFID data may be uploaded by RAT 400 to an AP 510 through a beam 520 having an orientation determined by beam forming interface 470 of FIG. 4. Because the RFID scan is internal to the container, beam forming interface 410 may also be denoted as an internal beam forming interface. In contrast, AP 510 is typically somewhat remote from RAT 400 such that beam forming interface 470 may be denoted as an external beam forming interface.

RAT 400 may be removably connected to container/pallet 500 using, for example, Velcro or other types of temporary adhesives. The 802.11 antennas may be provided on an internal card to RAT 400 such as a PCMCIA card. However, RFID antennas are typically lower frequency and thus larger than those used for 802.11 communication. For example, 802.11 communication is often performed at 2.4 GHz whereas RFID interrogation may be performed at just 900 MHz. Thus, it is convenient to implement RFID antennas 420 externally to RAT 400 and also removably connected to container/pallet 500. Having affixed the RFID antennas and RAT 400 to container/pallet 500, a user would then couple RFID antennas 420 to RAT 400 to complete the configuration.

Figure 6B:
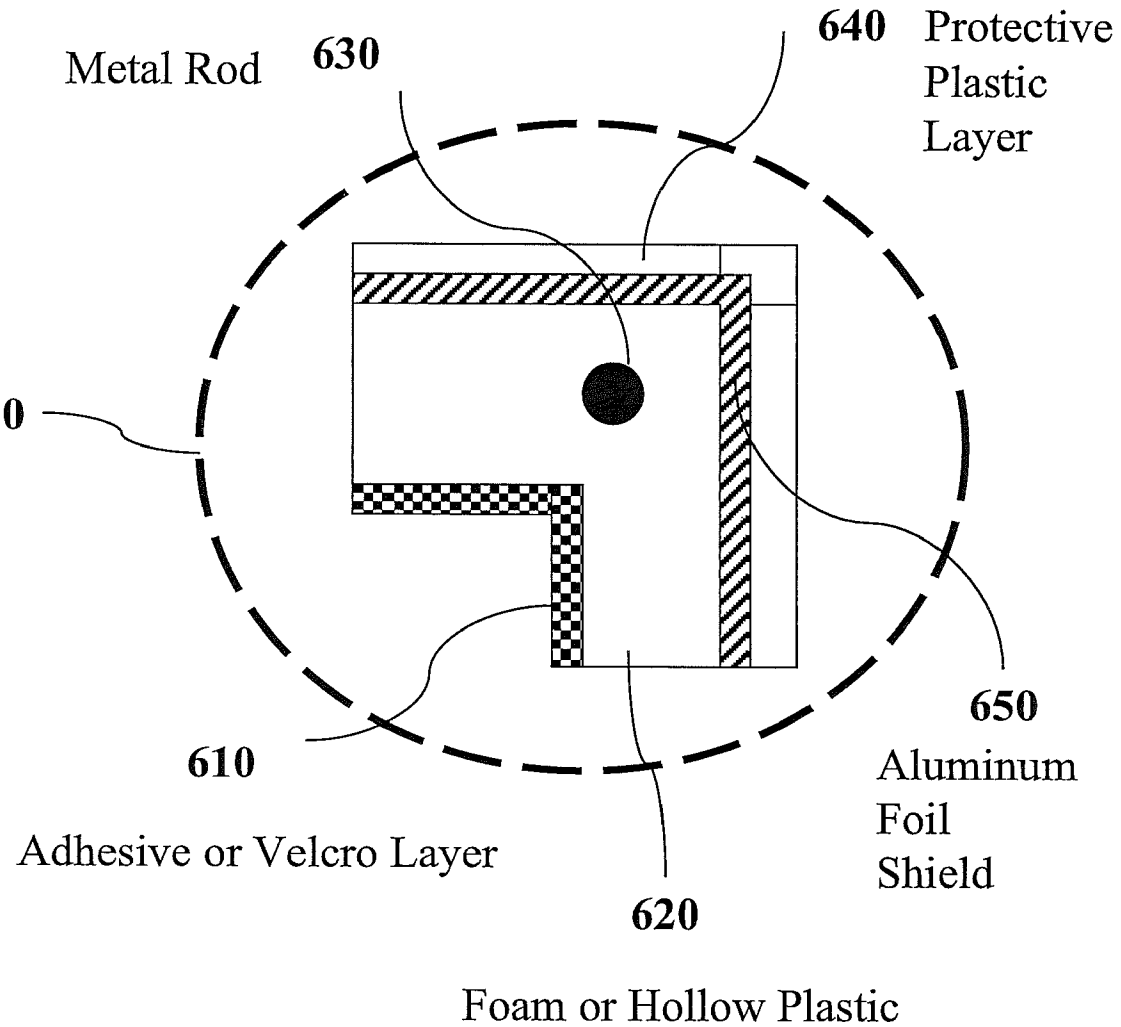
FIG. 6*b* is a cross-sectional view of the monopole RFID antenna of FIG. 6*a*.
Figure 6A:
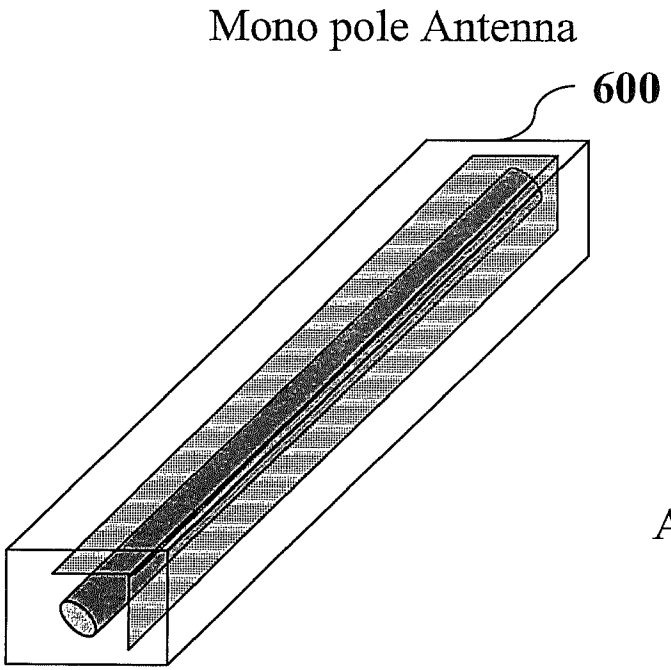
FIG. 6*a* is a perspective view of a monopole RFID antenna in accordance with an embodiment of the invention.

It will be appreciated that any suitable antenna topology such as, for example, monopole, patch, dipole, or patch may be used to implement RFID antennas 420 and 802.11 antennas 480. A convenient topology for RFID antennas 420 is a monopole such as a monopole 600 illustrated in FIG. 6*a*. As seen in cross-sectional view in FIG. 6*b*, monopole 600 may comprise a metal rod 630 surrounded by an inexpensive insulator such as plastic foam 620. Because pallet/container 500 to which monopole 600 will be attached typically has a rectangular shape, plastic foam 620 may have an angular cross-section such that monopole 600 may be affixed to an angular edge of pallet/container 500. An inner surface of the angular cross-section may include an adhesive layer such as Velcro that enables monopole antenna 600 to be removably affixed to pallet/container 500. To keep the radiation from monopole antenna 600 directed within the contents of pallet/container 500, an outer surface of insulating layer 620 may be covered with a reflecting metallic shield such as aluminum foil shield 650. Shield 650 may be further covered with a protective layer such as a plastic layer 640.

The above-described embodiments of the present invention are merely meant to be illustrative and not limiting. It will thus be obvious to those skilled in the art that various changes and modifications may be made without departing from this invention in its broader aspects. The appended claims encompass all such changes and modifications as fall within the true spirit and scope of this invention.

I claim:

1. An RFID reader and active tag (RAT) for interrogating a plurality of RFID tags occupying a space, comprising:

a first antenna;

a second antenna orthogonally aligned with the first antenna;

an RFID interface operable to generate RF transmissions to the interrogate RFID tags;

a fixed phase variable gain beam forming interface coupled to the first and second antennas and to the RFID interface, the variable gain beam forming interface being operable to independently adjust a set of gains for the RE transmissions from the RFID interface to the antennas so as to steer an interrogating RF transmission throughout the space to obtain RFID data from the RFID tags within the space;

a third antenna; and a wireless interface configured to communicate through the third antenna with an access point, the wireless interface being operable to transmit the RFID data to the access point.

2. The RAT of claim 1, further comprising a logic engine to control the steering provided by the fixed phase variable gain beam forming interface.

3. The RAT of claim 1, wherein the wireless interface is an IEEE 802.11 interface.

4. The RAT of claim 1, wherein the first and second antennas are removably attached to the RAT.

5. The RAT of claim 4, wherein the first and second antennas are monopole antennas.

6. The RAT of claim 5, wherein each monopole antenna is contained with an insulating layer having an angular cross section such that the monopole antenna can engage an angular edge of a container holding the RFID tags.

7. The RAT of claim 6, wherein an outer edge of the insulating layer is covered by a conducting reflecting layer and wherein an inner edge of the insulating layer is covered by an adhesive layer.

8. The RAT of claim 7, wherein the conducting reflecting layer comprises aluminum foil and the adhesive layer comprises VELCRO adhesive.

9. The RAT of claim 1, further comprising a PCMCIA card, wherein the third antenna is integrated within the PCMCIA card.

10. A method for interrogating a plurality of RFID tags occupying a space using a first antenna and a second antenna orthogonally aligned with the first antenna, comprising:

producing an RF interrogating signal for interrogating the RFID tags;

amplifying the RF interrogating signal through a first variable gain amplifier to drive the first antenna;

amplifying the RF interrogating signal though a second variable gain amplifier to drive the second antenna; and changing a gain for the first variable gain amplifier and a gain for the second variable gain amplifier such that a resulting RF transmission from the first and second antennas steers through the space to interrogate all the RFID tags to obtain RFID data.

11. The method of claim 10, further comprising uploading the RFID data to an external access point.

12. The method of claim 11, wherein the uploading of the stored RFID data is performed though an additional plurality of antennas using beam forming so as to direct an RF beam at the external access point.

13. The method of claim 12, wherein the external access point is an IEEE 802.11 access point.

14. An RFID reader and active tag (RAT), comprising:

a first beam forming means for interrogating a plurality of RFID tags using at least a first set of two antennas coupled to a first fixed phase feed network, the beam forming means being configured to adjust gains in the first fixed phase feed network to scan with respect to the plurality of RFID tags; and a second means for uploading RFID data from the interrogated plurality of RFID tags to an external access point.

15. The RAT of claim 14, wherein the second means uploads the RFID data using beam forming.

* * * * *